United States Patent [19]

Dlugopolski

[11] 4,189,087

[45] Feb. 19, 1980

[54] FOLDING BOX WITH A DRAWER MADE FROM SINGLE BLANK

[76] Inventor: Joseph Dlugopolski, 260 E. Taylor Rd., Lombard, Ill. 60148

[21] Appl. No.: 945,239

[22] Filed: Sep. 25, 1978

[51] Int. Cl.[2] ..... B65D 5/38

[52] U.S. Cl. ..... 229/19; 229/33

[58] Field of Search ..... 229/19, 9, 10, 11, 33, 229/34 R, 31 FS

[56] References Cited

U.S. PATENT DOCUMENTS

| | | | |
|---|---|---|---|
| 2,960,149 | 11/1960 | Throssel | 229/34 R X |
| 3,317,112 | 5/1967 | Futterman | 229/19 |
| 4,009,820 | 3/1977 | Fitzgerald | 229/33 |

FOREIGN PATENT DOCUMENTS

| | | | |
|---|---|---|---|
| 159686 | 4/1905 | Fed. Rep. of Germany | 229/19 |
| 965563 | 6/1957 | Fed. Rep. of Germany | 229/19 |
| 979302 | 1/1965 | United Kingdom | 229/19 |

*Primary Examiner*—Davis T. Moorhead

*Attorney, Agent, or Firm*—Laff, Whitesel & Rockman

[57] ABSTRACT

A single and unitary blank has a plurality of housing forming panels on one end and a plurality of drawer-forming panels on the other end. The housing and drawer panels are joined by a series (here, three) of drawer position control panels which allows the drawer to be pulled far enough to enable the contents thereof to be inserted or removed. However, the series of drawer position control panels also restrains the drawer and prevents it from being completely removed.

12 Claims, 11 Drawing Figures

FOLDING BOX WITH A DRAWER MADE FROM SINGLE BLANK

This invention relates to folding boxes and, more particularly, to the combination of a box containing a drawer, made from a one-piece blank, with a minimum number of folding steps.

An object of the invention is to provide a folded box housing with a sliding drawer formed therein. Here, an object is to provide such a housing and drawer combination, made from a single, unitary blank of cardboard, plastic, metal, or any other suitable material. In this connection, an object is to provide such a housing and drawer combination which can be made from any suitable material and erected with a minimum number of assembly steps.

Another object of the invention is to provide a housing and drawer combination with a series of control panels which limits the distance which the drawer may be pulled out of the housing.

Yet another object of the invention is to provide new and improved means for and methods of packaging products in folded box containers which may be repeatedly opened and closed quickly and easily, without damage to the box. Here, an object is to provide sturdy boxes which protect the products enclosed therein.

In keeping with an aspect of the invention, these and other objects are accomplished through a use of a unitary blank having a plurality of housing panels formed on one end and a plurality of drawer panels formed on the other end thereof. The housing and drawer panels are interconnected by a series of drawer position control panels which permit the drawer to be pulled out of the housing far enough to enable the contents thereof to be inserted or removed. However, the drawer position control panels restrain and prevent the drawer from being completely removed.

The preferred embodiment of the invention is shown in the attached drawings, wherein.

Figure 1:
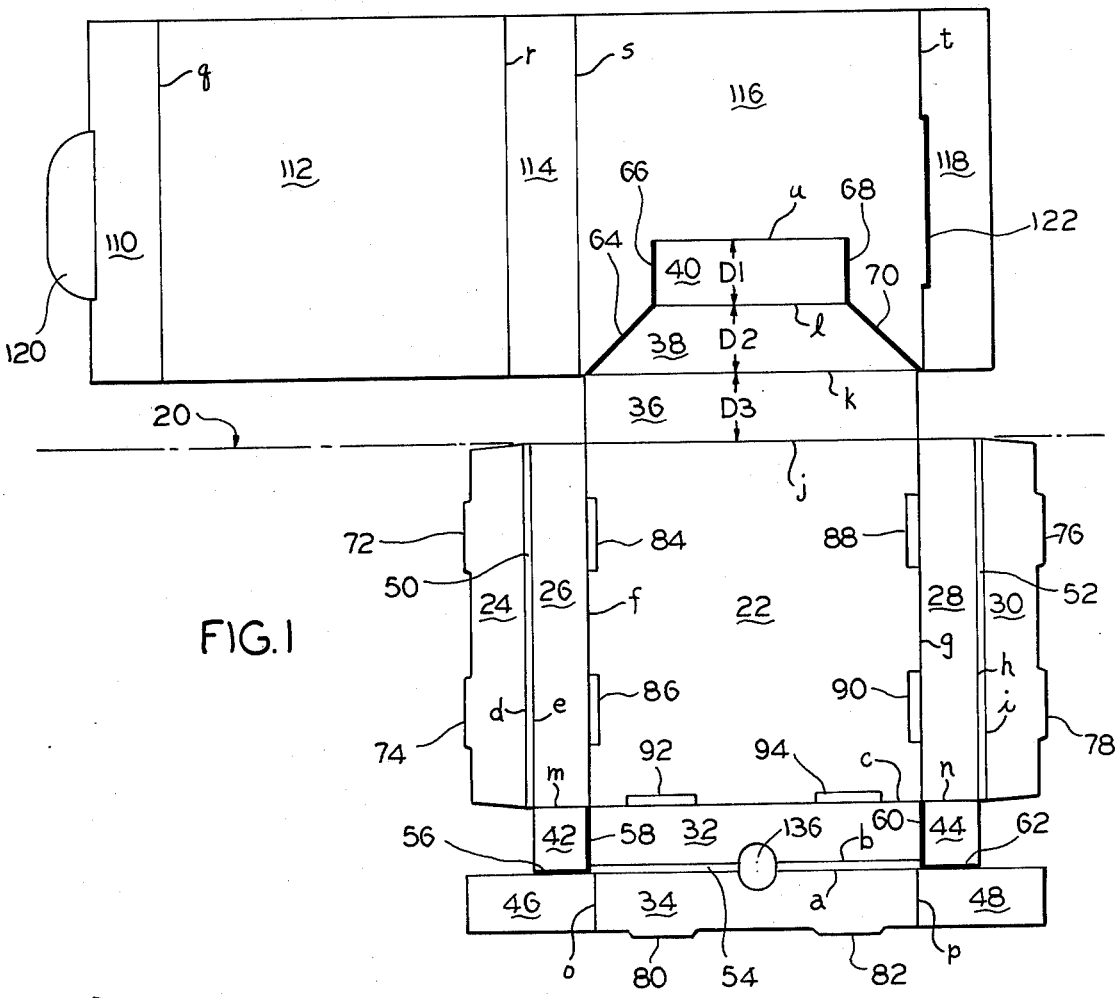
FIG. 1 is a plan view of the inventive blank.

FIG. 1 shows the basic, unitary blank for making a box including a nonremovable drawer in a housing. This blank may be made from any suitable material, such as corrugated cardboard, for example. A dot-dashed line 20 is used in FIG. 1 to divide the portions of the blank (above the line) which forms a horizontal series of housing panels from the portions of the blank (below the line) which forms a vertical series of drawer panels. A series of control panels interconnect the housing and drawer panels in region 21.

The drawer panels include a drawer bottom 22 having opposing pairs of drawer side panels 24,26 and 28,30 integrally joined to the opposite sides thereof. A pair of drawer end panels 32,34 are integrally joined to one end of the drawer bottom 22, and a series of three drawer position control panels 36,38,40 are integrally joined to the opposite end.

First or drawer side locking tabs 42,44 are integrally joined to the corresponding ends of the inner drawer side panels 26,28. Second or drawer end locking tabs 46,48 are formed on opposite ends of the outer drawer end panel 34.

Relief panels 50,52,54 are formed between the paired side and end panels in order to provide the spaces between the side and end panels which enable them to fold smoothly and easily over the four locking tabs 42,44,46,48.

The panels mentioned thus far are formed by source lines a–p. The blank is cut along the heavily inked lines 56–70. Of these cut lines, lines 64,66,68,70 form two of the series of control panels which join the drawer bottom panel 22 to a central region on the housing top.

Paired drawer side detents 72,74,76,78 are formed along the outer edges of the outer drawer side panels. Similar drawer end detents 80,82 are formed on outer drawer end panel 34. The drawer bottom panel 22 is pierced to form keeper notches at 84,86,88,90, to receive the side panel detents 72,74,76,78, respectively, and at 92,94 to receive the end panel detents 80,82, respectively.

Figure 2:
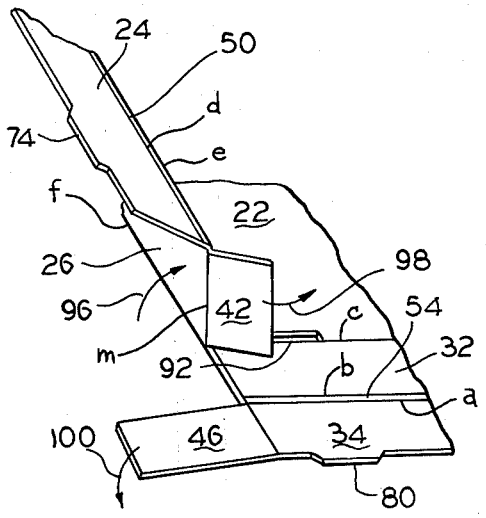
FIG. 2 is a stop motion view of a fragment of a corner of the drawer, showing a first step in a drawer folding process.
Figure 3:
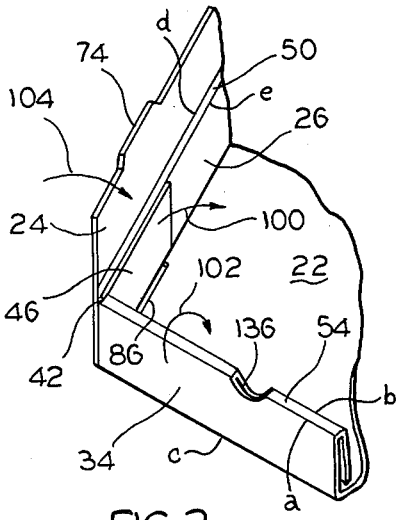
FIG. 3 is a similar stop motion view showing a second folding step.
Figure 4:
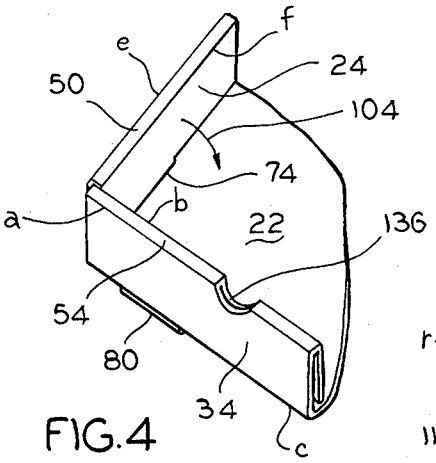
FIG. 4 is a similar stop motion view showing a third folding step including a completely folded corner of the drawer.

The manner of folding the above-mentioned panels, in order to form the drawer, will be understood best from a study of FIGS. 2–4.

First, the drawer side locking tabs 42,44 are pulled upwardly out of the plane of FIG. 1 (swinging on score lines m,n), to project toward the reader. Then, the inner side panels 26,28 are folded upwardly along score lines f,g. In FIG. 2, the side panel 26 is seen folding in direction 96 along score line f. The drawer side locking tab 42 is seen swinging, in direction 98, toward bottom panel 22 and along score line m.

The next step is to fold the drawer end locking tabs 46,48 along score lines o,p, downwardly and out of the plane of FIG. 1, to project away from the reader. FIG. 2 shows this tab 46 swinging downwardly in direction 100.

The end panels 34,32 are pulled (direction 102, FIG. 3) upwardly and out of the plane of FIG. 1, folding along score lines a,b,c, while the drawer end locking tabs 46,48 are held in the downward position (direction 100) in which they have previously been moved. The drawer side locking tabs 42,44 are captured between the drawer end panels 32,34 and within the space provided under the fold relief panel 54. The drawer end locking tabs 46,48 come to rest against the inside surface of the upright inner side panels 26,28. Drawer end detents 80,82 snap into keeper notches 92,94.

The outer drawer side panels 24,30 are folded inwardly along score lines d,e,h,i, respectively. FIG. 3 shows panel 24 so folding in direction 104. The drawer end locking tabs 46,48 are captured between drawer side panels 24,26 and 28,30, respectively, and within the space formed under the fold relief panels 50,52, respectively. The drawer side detents 72,74,76,78 snap into the drawer side detent keepers 84,86,88,90, respectively. The completed corner is seen in FIG. 4. This completes the drawer which is locked into its upright position by the detents snapped into their associated keepers.

The housing portion of the blank (FIG. 1) comprises a series of five panels 110,112,114,116,118 which are differentiated by the score lines q–t. Panel 110 is a housing side panel having a connecting flap 120 integral therewith. A second housing side panel 118 includes a keeper 122 for receiving flap 120. Panel 112 forms the bottom and panels 110,114,118 form the sides of the housing.

The series of drawer control panels 36,38,40 connect the drawer into the housing top panel 116. The control panels 48,38 are separated from the top panel and are formed by cut lines 64,66,68,70.

Figure 5:
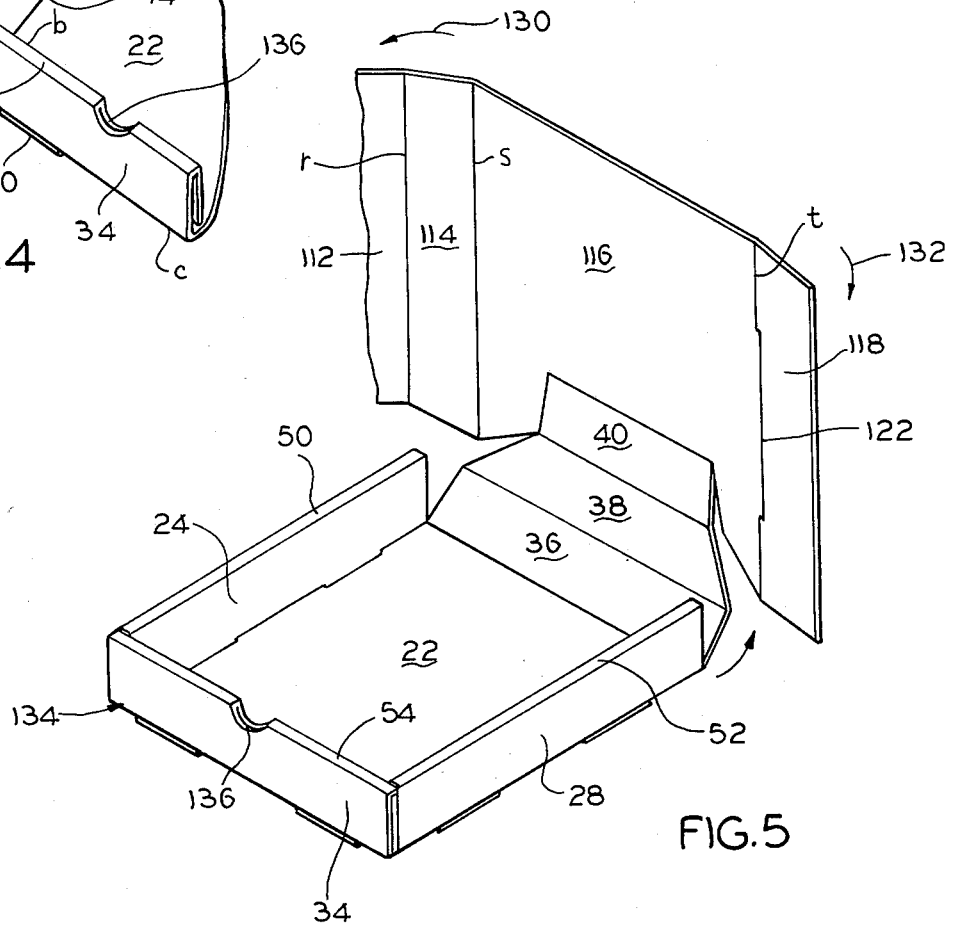
FIG. 5 is a stop motion view showing a fourth folding step wherein the housing is being formed over a completely folded drawer.
Figure 6:
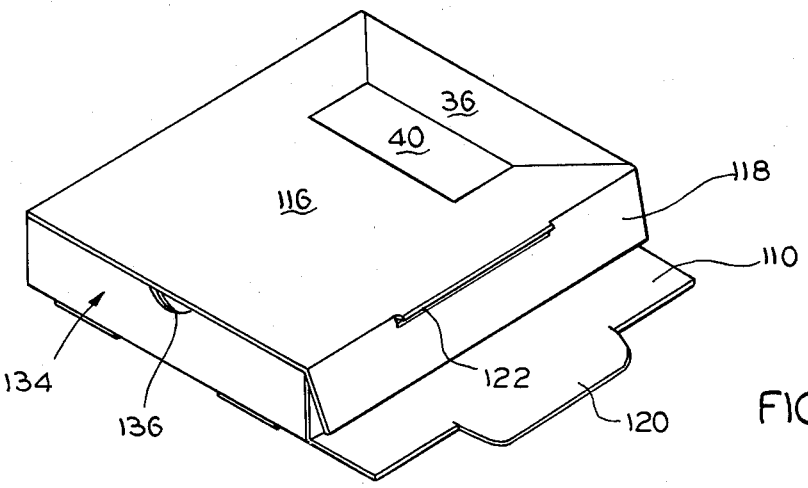
FIG. 6 is a stop motion view showing a fifth folding step wherein the housing is completely enclosing the folded drawer.

The folding of the housing panels is illustrated in FIGS. 5 and 6. Panel 116 is lifted (FIG. 5), with the panels 36,38 folding along their score lines j and k. Side panels 114 and 118 are lifted in the directions of arrows 130 and 132, and folded along score lines r,s,t, respectively. The housing panels 110–118 are wrapped around the previously folded drawer 134, to form an open-ended tube and flap 120 is tucked into the flap keeper 122.

A hole 136 (FIG. 1) is punched through the center of the drawer end panels 32,34 to form an opening (FIGS. 5, 6) which may be grasped by a finger and then used to pull the drawer 134 out of the housing.

Figure 7:
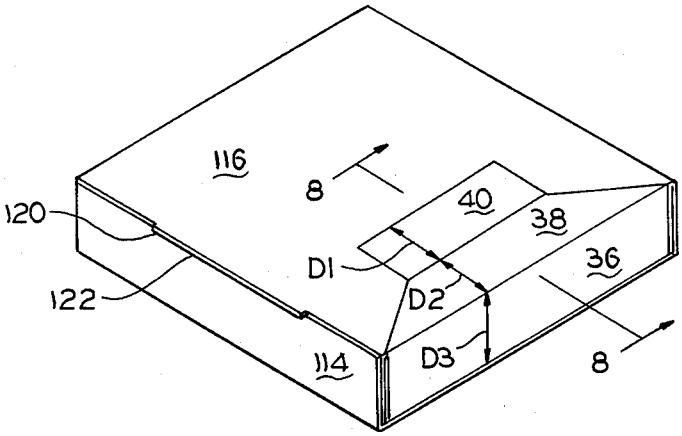
FIG. 7 is a perspective view of the rear of a completed drawer and housing combination.

As seen in FIG. 7, three control panels 36,38,40 complete both the top of the housing and the back of the drawer, when it is closed. The distances D1,D2 should not be greater than the distance D3. Stated another way, control panels 38,40 should not be wider than control panel 36 or the depth of the housing since they must swing over center, as the drawer moves out of the housing.

Figure 8:
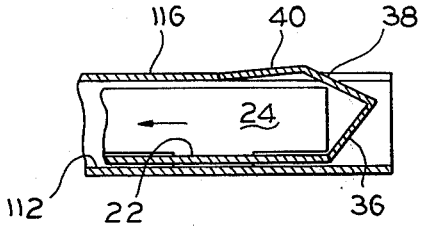
FIG. 8 is a cross section taken along line 8—8 of FIG. 7 which shows the articulation of control panels as the drawer is first pulled from the housing.

FIG. 8 shows how the control panels 36,38,40 begin to articulate as the drawer 136 begins to move. The control panel 36 moves into the housing along with the drawer bottom panel, to which it is attached and begins to follow the drawer movement. The control panel 36 pulls the control panel 38 in a downward direction. The control panel 40 hardly moves at all during this initial drawer movement; however, it is free to lift slightly, if required, to enable the control panels 38,36 to articulate. If panel 38 should be wider than the housing depth, of course, panel 40 would lift more than the small amount shown in FIG. 8. The preferred embodiment has control panels which are narrow enough so that the panel 40 does not have to lift at all. Then, a plurality of the boxes may be stacked.

Figure 9:
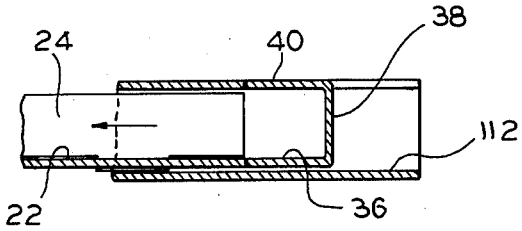
FIG. 9 is a cross sectional view also taken along line 8—8 of FIG. 7 showing the articulation of the control panels when the drawer is pulled about one-half way out of the housing.
Figure 10:
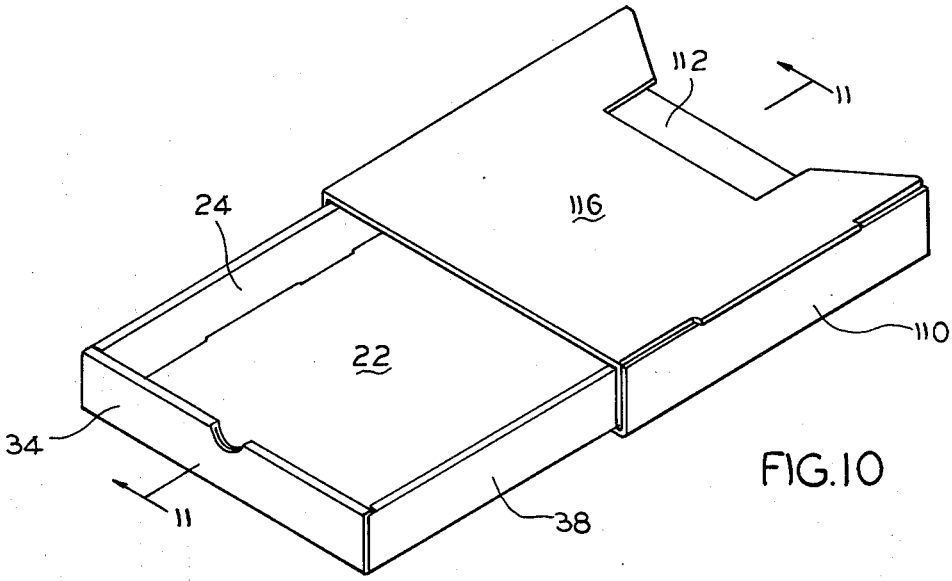
FIG. 10 is a perspective view of the drawer pulled out of the housing as far as the control panels permit it to move.
Figure 11:
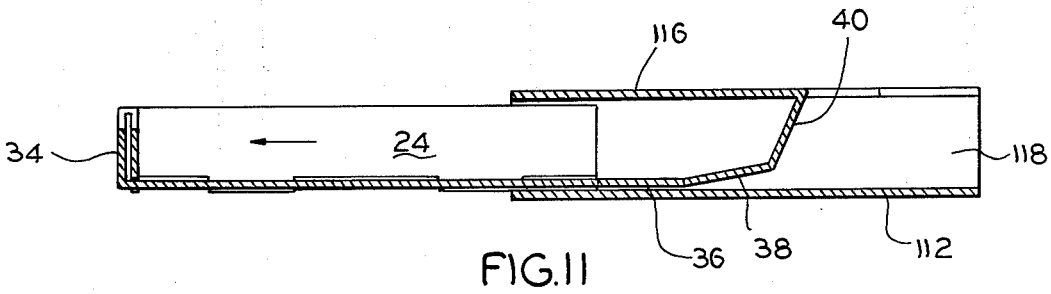
FIG. 11 is a cross section taken along line 11—11 of FIG. 10 showing the fully articulated control panels.

When the drawer reaches approximately the halfway position (FIG. 9), the control panel 38 is standing substantially perpendicular in the long dimension of the housing. As the drawer continues to move out of the housing (FIGS. 10, 11) the control panels 36,38,40 tend to straighten out inside the housing and to limit the outward travel of the drawer. The width of panel 40 must not exceed the depth of the housing or the width of panel 118, so that panel 40 may swing freely within the clearance between top and bottom housing panels 116,112.

If the depth of the housing and the drawer are shallow enough, several score lines may be added across the width of the control panels 38,40, to increase the number of control panels in the series so that each narrow panel may swing through the depth.

The drawer may be arranged to travel different distances, relative to the length of the housing by changing the total length of the entire series of control panels.

Those who are skilled in the art will readily perceive how to modify the system. Therefore, the appended claims are to be construed to cover all equivalent structures which fall within the true scope and spirit of the invention.

I claim:

1. A folding box with a drawer made from a single blank comprising a series of housing panels formed by score lines positioned along one end of said blank, a plurality of drawer panels formed by score lines positioned along the other end of said blank, and a series of articulated drawer position control panel means interconnecting a center region of a top one of said housing panels and a rear edge of a bottom one of said drawer panels, each of said control panel means being shaped and having dimensions which fold entirely within said box when said drawer is slid within said box, said drawer panel means folding to form a generally rectangular bottom panel having upstanding walls positioned along three contiguous edges thereof, whereby said control panel means constitutes an extension from the fourth edge of said drawer bottom panel into one of said housing panels and moves between said top one of said housing panels and said drawer bottom panel.

2. The box and drawer of claim 1 wherein at least one of said control panel means is formed by cut lines in the top panel of said housing, whereby said central region in the top of the housing is connected to the bottom of the drawer by the control panel means.

3. The box and drawer of claim 1 wherein said drawer panel means comprises a pair of side panels on opposite ones of said three of contiguous edges of said bottom panel and a pair of end panels on the third and central one of said three contiguous edges of said bottom panel, said third edge which forms the drawer end being opposite to said fourth edge to which said control panels connect.

4. The box and drawer of claim 3 and relief panels positioned between the panels of each of said pair, and locking tabs formed on one of said side panels and one of said end panels, said locking tabs fitting within the spaces under said relief panels.

5. A unitary blank for forming a drawer in a housing, said blank comprising a horizontal series of housing forming panels separated by score lines for forming the top, bottom and two sides of a four-sided box, a vertical series of drawer-forming panels separated by score lines, said vertical series extending from at least one of an articulated series of drawer position control panels formed by cut lines in one of the panels in said horizontal series, said cut lines leaving side flanges in said one panel in said horizontal series, said series of drawer position control panel being followed by a drawer bottom panel having an integral pair of end-forming panels on one end of said drawer bottom, and an integral pair of side-forming panels on opposite sides of said bottom panel.

6. The blank of claim 5 wherein at least one detent is formed on the outboard edge of each of said pair of side and end panels and keeper notches formed in the bottom panel for receiving said detents to hold said drawer sides in upright positions.

7. The blank of claim 5 wherein there are at least four panels in said horizontal series with means on one end of said series for attaching that one end to the other end of said series whereby said four panels form an open-ended tube.

8. The blank of claim 5 wherein there are five panels in said horizontal series of said panels and attaching means comprising a flap on one end and a flap keeper notch on the other end of said horizontal series of five panels, whereby said housing forms an open-ended tube when said flap is tucked into said flap keeper.

9. A unitary blank for forming a drawer in a housing, said blank comprising a horizontal series of housing forming panels separated by score lines for forming the top, bottom and two sides of a four-sided box, a vertical series of drawer-forming panels separated by score lines, said vertical series extending from one of the panels in said horizontal series and comprising at least one drawer position control panel followed by a drawer bottom panel having an integral pair of end-forming panels on one end of said drawer bottom, and an integral pair of side-forming panels on opposite sides of said bottom panel, said vertical series of panels comprising at least three drawer control panels, at least two of said drawer control panels being formed by cut lines in said one panel in said horizontal series of panels, whereby said control panels begin to fold along a line which is generally in a central portion of said one panel, said control panels being formed by score lines oriented transversely to a direction in which said drawer slides, each of said control panels having a width which is no greater than the depth of said drawer.

10. The blank of claim 9 wherein the uppermost one of the three control panel is joined to said one panel in said horizontal series, and a bottom drawer panel connected to the lowermost one of said three control panels, a pair of end panels connected to said bottom drawer panel on an end opposite the control panels and a pair of side panels connected to said bottom drawer panel on opposed sides thereof, intermediate said control panel and said end panels.

11. The blank of claim 10 and drawer end locking tabs on opposite ends of one of said end panels and drawer side locking tabs formed on corresponding ends of one side panel on each side of the bottom panel, each of said pair of side panels folding over a drawer end locking tab on said one end panel, and said pair of end panels folding over a drawer side locking tab formed on each of said corresponding ends of said side panels.

12. A drawer fitting entirely within a box made from a single unitary, folding corrugated cardboard blank, without requiring any glue or other separate fastening means, wherein said folded blank is secured in place solely by detents or flaps which fit into keeper slots, and said drawer and box are joined by drawer position control panels being defined by a series of horizontally oriented score lines, the widths of said drawer control panels being narrow enough to fold and articulate entirely within said box and thereby enable limited drawer movement.

* * * * *